United States Patent [19]

Bryant

[11] Patent Number: 4,815,299

[45] Date of Patent: Mar. 28, 1989

[54] KNITTED FABRIC HAVING IMPROVED ELECTRICAL CHARGE DISSIPATION PROPERTIES

[75] Inventor: Kenneth G. Bryant, Charlotte, N.C.

[73] Assignee: Conductex, Inc., Charlotte, N.C.

[21] Appl. No.: 940,864

[22] Filed: Dec. 12, 1986

[51] Int. Cl.[4] ..... D04B 7/16

[52] U.S. Cl. ..... 66/202; 66/195

[58] Field of Search ..... 66/202, 190, 192, 193, 66/195; 139/425 R, 425 D; 428/242; 57/901; 361/220; 174/117 M

[56] References Cited

U.S. PATENT DOCUMENTS 3,699,590 10/1972 Webber et al. ..... 2/73
3,806,959 4/1974 Gross ..... 66/192 X
4,335,589 6/1982 Flasher ..... 66/202

FOREIGN PATENT DOCUMENTS 61-27085 2/1986 Japan ..... 66/202

*Primary Examiner*—Ronald Feldbaum
*Attorney, Agent, or Firm*—Kenyon & Kenyon

[57] ABSTRACT

A knitted fabric having improved electrical charge dissipation properties, constructed so as to form a conductive matrix capable of discharging an electrical charge along any direction of the course and wale of the fabric.

7 Claims, 3 Drawing Sheets

KNITTED FABRIC HAVING IMPROVED ELECTRICAL CHARGE DISSIPATION PROPERTIES

BACKGROUND OF THE INVENTION

1. Field of the Invention

This invention relates to a new and improved knitted fabric having improved electrical charge dissipation properties. More specifically, this invention relates to a readily manufactured knitted fabric comprised of nonconductive yarn that extends along the wale and combined with conductive fibers that form overlaps and underlaps within the nonconductive knit to such an extent so as to form a combined stitch construction, e.g., a modified "Queen's Cord" construction, providing an electrically conductive matrix capable of quickly dissipating charge along any direction of both the course and wale.

2. Description of the Prior Art

Electrostatic charge accumulates on clothing as the wearer moves his or her arms and legs and as he or she walks on non-conductive floor surfaces. The accumulation of such static charge poses a special problem in tight-fitting garments such as hosiery and sporting apparel in which static charge causes adjacent garments to cling to one another. This static cling causes both discomfort for the wearer and unpleasant shocks. Such charge accumulation can also create significant problems where the wearer works in an environment in which any static charge is undesirable or dangerous.

A need exists, therefore, for a means to control electrostatic charge accumulation on fabric, particularly fabric used in clothing worn by individuals who occupy or handle materials in areas in which an electrostatic discharge could be hazardous to the individual or could damage material which is being handled by the wearer, e.g., in operating rooms where potentially explosive gases are present or in "clean rooms" where electrically sensitive microcircuits are manufactured.

The utilization of fibers possessing electrical conductivity (e.g., metal fibers, fibers coated with electrically conductive material, or metal laminate filaments) in combination with common natural and manmade fibers to produce a woven, knitted, netted, tufted, or otherwise fabricated structure, which readily dissipates static charge as it is generated is well known.

In U.S. Pat. No. 3,823,035, issued to Sanders, an electrically-conductive textile fiber is disclosed in which finely-divided electrically conductive particles are uniformly suffused in a filamentary polymer substrate. Sanders discloses the interweaving of such electrically conductive fibers with ordinary threads made from natural fibers such as cotton or wool in an amount sufficient to render the electrical resistance of the fabric to a value of $10^9$ ohms/cm.

U.S. Pat. No. 4,312,913, issued to Rheaume, discloses a heat-conductive woven fabric comprising a plurality of fill layers of weavable yarns, each yarn comprising a plurality of fibers that are metallic or are coated with an effective amount of a metallic, heat conducting material. An angle weave pattern is woven through the layers of fill yarns in Rheaume, and this angle woven pattern extends from the top to the bottom of several layers of fill yarns.

Similarly, U.S. Pat. No. 4,296,855, issued to Blalock, also discloses a woven pattern of filler and warp yarns comprised of an electrically insulating material suffused with electrically conducting carbon particles, the warp and filler being woven in an open mesh configuration.

U.S. Pat. No. 4,422,483, issued to Zins, discloses a multiplicity of elongated filaments which are essentially parallel to each other and which form a single ply of a conductive thread for woven fabrics. The elongated filaments in Zins are non-textured continuous, non-conductive filaments or warp threads which are combined together with conductive filaments or fill threads to form a conductive woven fabric.

Neither Sanders, Rheaume, Blalock or Zins disclose a conductive knitted fabric. While U.S. Pat. Nos. 4,443,515, issued to Atlas, and its divisional 4,484,926, disclose that conductive fibers comprised of synthetic polymers may be incorporated into knitted fabrics, those references do not disclose a pattern whereby such conductive fibers can be economically incorporated into a knitted fabric so as to dissipate static electricity in any direction along the course and wale directions of the fabric.

U.S. Pat. No. 4,398,277, issued to Christiansen et al., does disclose a pattern whereby insulative yarn and electrically conductive yarn are knitted together on two levels The insulative yarn in Christiansen et al. forms a series of interlocking loops on both the technical face and back of the fabric in a tricot construction, while the electrically conductive yarn forms a series of chain stitches on only the technical face. Christiansen et al. disclose that when their fabric is knitted in such a two layer construction, one of the surfaces (i.e., the technical face) will be relatively nonconductive. Electrical charge dissipation in such a construction, therefore, is limited to the wale direction of the technical face of the fabric.

Attempts have been made to develop a knitware pattern that can be economically manufactured, which require the use of a relatively small amount of conductive fiber and which possess electrical conductivity along both the course and wale directions and on both the technical face and back of a two layer knitted fabric. A knitted fabric in which conductive yarn is knitted in an argyle pattern together with nonconductive yarn, resulting in a fabric having electrical conductivity along the course and wale directions on both the technical face and back, has been constructed.

The argyle construction suffers from several disadvantages. Such a construction requires that the conductive fiber be stitched simultaneously along both the course and wale directions to form a saw-tooth pattern known as an "Atlas stitch" which, when joined to a similar adjacent stitch, forms the argyle pattern. Such simultaneous horizontal and vertical movement of fiber requires that the argyle knit be manufactured on a knitting machine having at least two separate guidebars dedicated to the argyle construction. Further, the argyle construction requires the use of a substantial amount of conductive yarn, which is a significant disadvantage given that such yarn is currently more than about thirty-six times as expensive as nonconductive yarn. An additional significant disadvantage of this conductive argyle construction is that it can only be fabricated by a relatively complex warp knitting machine, i.e., one having two or more dedicated guidebars as mentioned above.

A need exists, therefore, for a relatively inexpensive easily knitted fabric capable of rapidly and effectively discharging static electricity. Further, the need exists for such a knitted fabric which is capable of discharging static electricity along the course and the wale directions of the fabric and on the technical back and/or face of the fabric. Further, there is also a need for such an antistatic knitted fabric which can be manufactured on a conventional knitting machine that is not as mechanically complex as those required for complex knits, e.g., double argyle, presently used in the industry.

Accordingly it is an object of the present invention to provide a knitted fabric having improved electrical charge dissipation properties.

It is a further object of the present invention to provide such a knitted fabric in which an electrostatic charge can be dissipated both along the course direction of the knitted fabric and the wale direction of the knitted fabric on the technical back and/or face.

It is a further object of the present invention to provide a knitted fabric having improved electrical discharge dissipation properties in which the percentage of conductive fiber employed in the fabric is significantly less than that required in knitware construction disclosed in the prior art.

It is a still further object of the present invention to provide a knitted fabric which can be manufactured on a conventional knitting machine that is mechanically less complex than those machines presently used to manufacture conductive knitware, i.e., one that requires the use of only one dedicated guidebar.

Other objects and advantages will be in part obvious and in part hereinafter pointed out.

SUMMARY OF THE INVENTION

In accordance with the above-stated objects a knitted fabric having improved electrical charge dissipation properties is disclosed wherein a series of stitches comprised of nonconductive fibers arranged along the wale direction of the fabric are combined with conductive fibers that form overlaps and underlaps within the nonconductive knit to such an extent. so as to form a combined stitch construction, e.g., a modified "Queen's Cord" construction, so that adjacent conductive fibers are in electrical contact providing what is, essentially, an electrically conductive matrix capable of dissipating static charge along substantially any direction of both the course and wale of the fabric.

This invention also provides a method for manufacturing a knitted fabric having improved electrical charge dissipation properties comprising the steps of knitting chain stitches of nonconductive fiber along the wale direction with conductive fibers that extend along the course and wale directions and which forms overlaps and underlaps within the nonconductive knit to such an extent so as to form a fabric which is electrically conductive in substantially any direction.

BRIEF DESCRIPTION OF THE DRAWING

FIG. 2 illustrates the arrangement of the stitches of conductive fiber 1 extending along the course and wale directions and which forms- overlaps and underlaps within a nonconductive knit (not shown) so as to form the preferred modified Queen's Cord construction.

DETAILED DESCRIPTION

Figure 1:
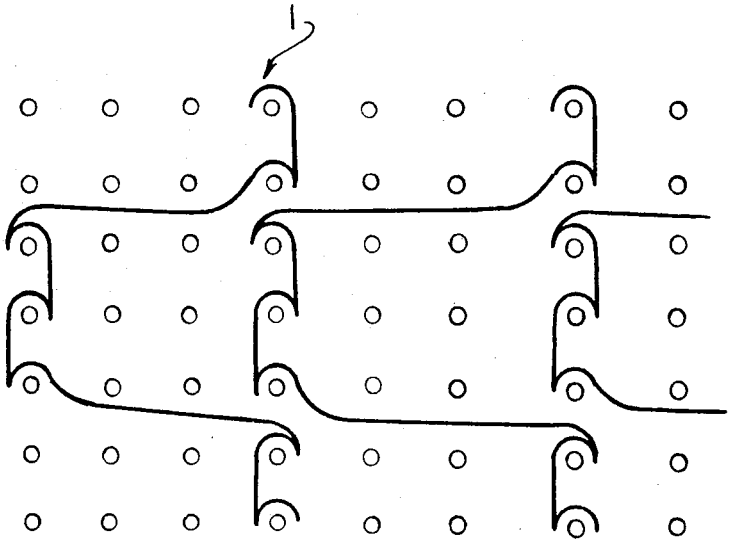
FIG. 1 is a lapping diagram which depicts the stitch formation of the conductive stitch of the present invention.
Figure 2:
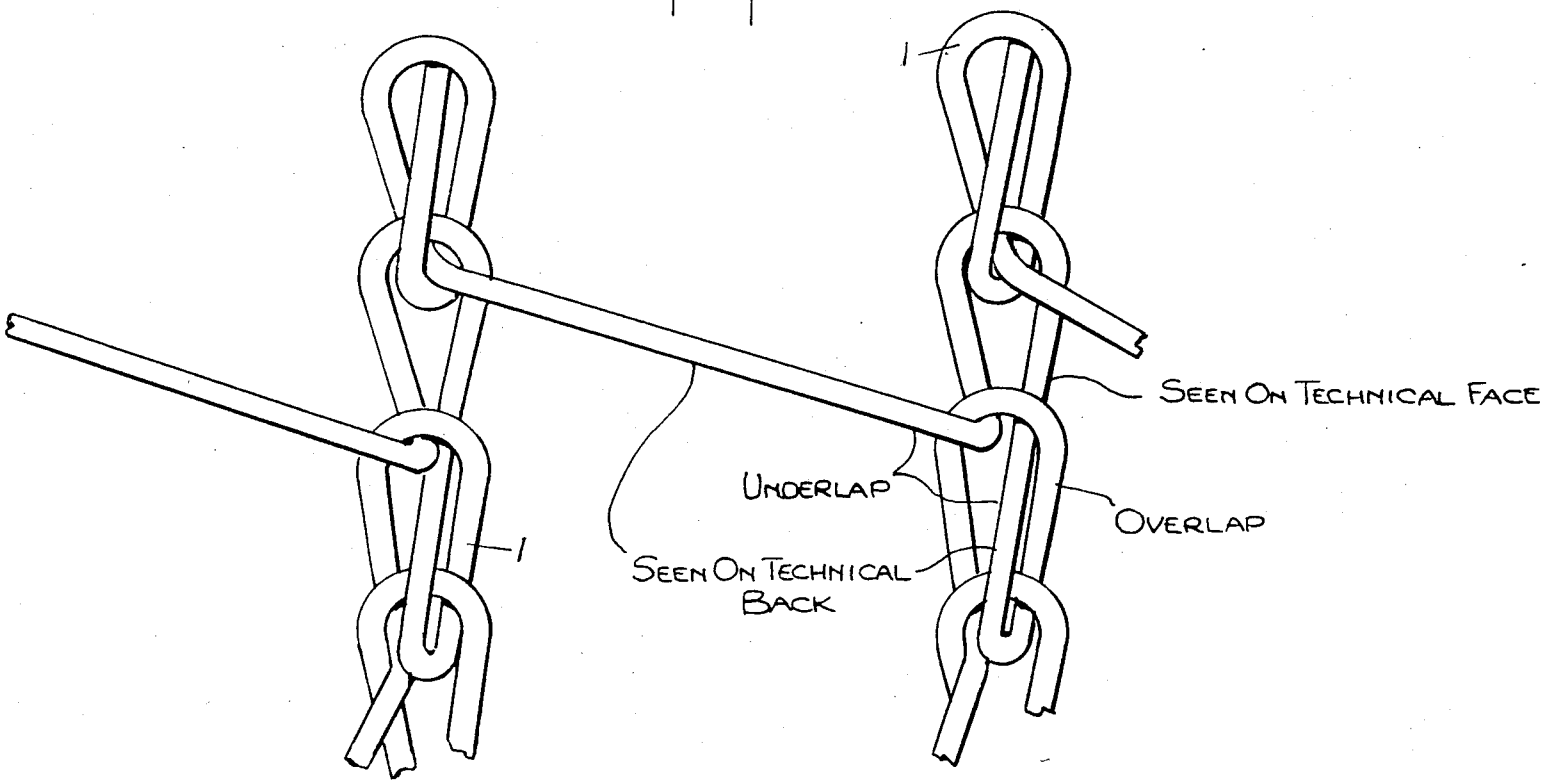
FIG. 2 depicts an enlarged section of the conductive stitch, shown in FIG. 1. This
Figure 8:
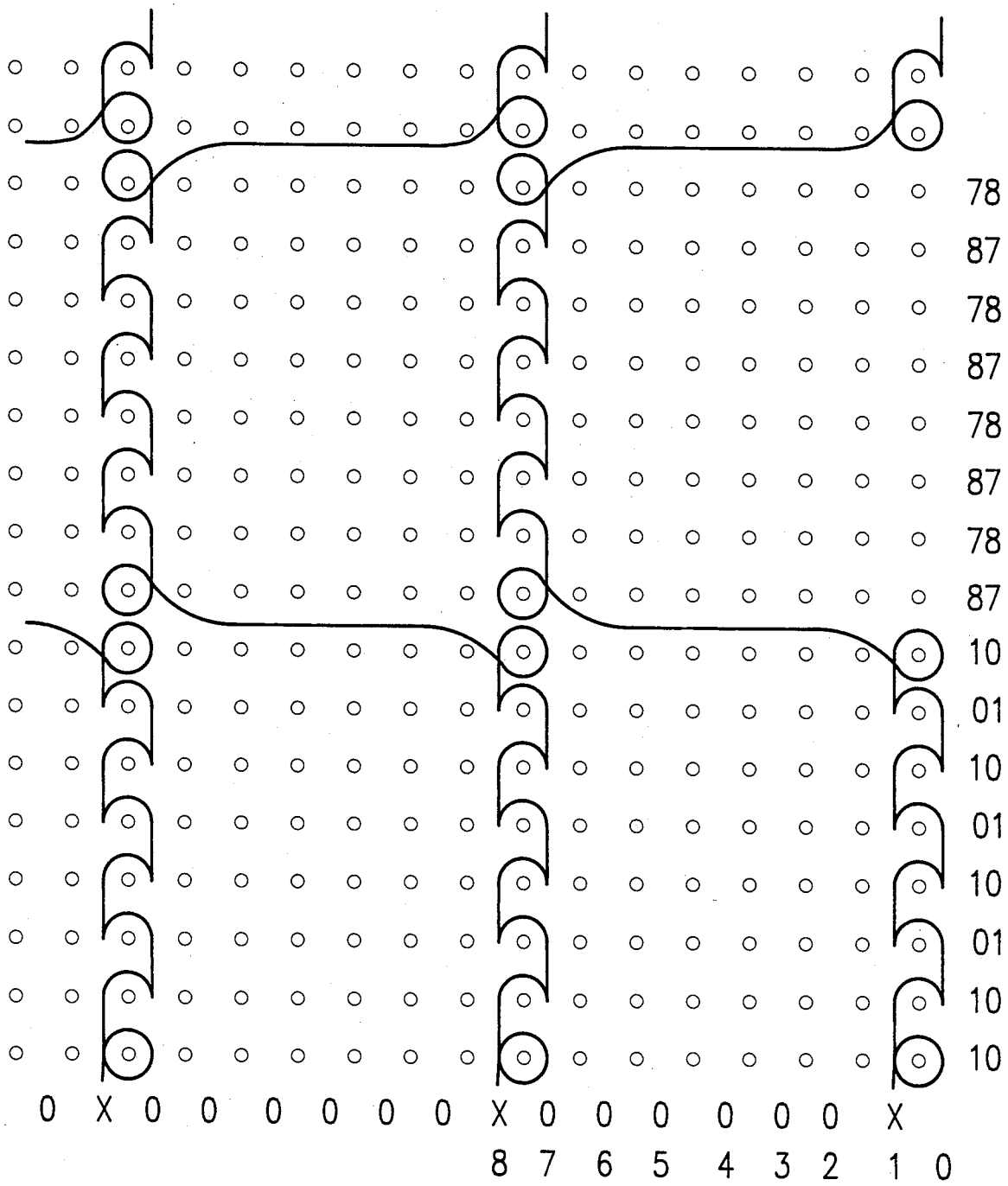

Referring to FIG. 1 and FIG. 2, the illustrated sequence of chain stitches may be formed on a knitting machine of the type well known in the art. See, e.g., "An Introduction the Stitch Formations in Warp Knitting" §1.3, pp. 27–42 (Employees Assoc. Karl Mayer E. V., West Germany 1966) (hereinafter "Stitch Formations" ) the entirety of which is incorporated herein by reference. A significant advantage of the present invention is that a knitting machine containing only one dedicated guide bar may be employed to fabricate the desired pattern of stitches of nonconductive fiber interlaced with conductive fiber 1.

As illustrated in FIG. 2, the dissipation of electrical charge along both the course and wale directions is ensured by the novel technique of forming underlaps and/or overlaps with the conductive fiber 1 within a nonconductive knit fabric along both the course and wale directions. This connection of conductive fiber 1 with adjacent nonconductive fibers results in a combined stitch construction, e.g., a modified "Queen's Cord" construction, that is electrically conductive along both the course and wale directions, and, when a two layered knit is fabricated, on both the technical face and back of the fabric. This modified Queen's Cord construction differs from known knit constructions in that the conductive fibers extend either along the course of the fabric or wale of the fabric, unlike the aforementioned argyle pattern in which the conductive fiber extends in a diagonal along the course or wale. "Stitch Formations", at p. 104, FIG. 155, depicts a "Queen's Cord" construction which is to be contrasted with the preferred embodiment of the present invention. It is an important feature of the present invention that the conductive fibers 1 form under and/or overlaps within the nonconductive fabric along the course and wale directions to such an extent that a conductive matrix is formed in which charge can be dissipated along any number of pathways in the course or wale direction of the technical face and back of the fabric.

In an alternative embodiment useful, e.g., as an antistatic wall covering, a knitted fabric can be constructed in accordance with the methods of the present invention wherein the conductive fiber is trapped between the overlaps and underlaps of the nonconductive knitted fabric as seen from the technical back.

The conductive fiber 1 can be selected from any of the number of types of conductive fibers commercially available, some of which have been considered in the preceding discussion of the prior art. These conductive fibers can consist either of singular yarns or be plied with other yarns where extra fabric strength or workability is desired.

EXAMPLE I

An example of the electrically conductive knitted fabric of the present invention was constructed as follows. The bottom bar of an 84 inch Mayer model KC3, 3 bar, 20 gauge warp knit tricot knitting machine was threaded full with 150 denier textured polyester and stitched 45-10. (Idler links for the 3 link per course set-up were omitted in this Example.) The middle bar of the machine was threaded 6 ends out and one end in with 70 denier textured polyester plied with 2 ends per thread of BASF conductive nylon and stitched in the following sequence:

1-0, 1-0, 0-1, 1-0, 0-1, 1-0, 0-1, 1-0, 7-8, 7-8, 8-7, 7-8, 8-7, 7-8, 8-7, 7-8,

An intermediate let off was set up for the middle bar on a ratio of 1.21 with a chain sequence as follows:

0-0-0, 6(4-4-4), 0-0-0, 0-0-0, 6(4-4-4), 0-0-0.

The top bar was threaded 6 ends in and 1 end out with 150 denier textured polyester and stitched 10-01. The knitted fabric so constructed was jet dyed and framed 72 inches wide and slit into 4 separate 18 inch strips. The runner lengths for this fabric were:

top bar: 80 inches per rack
middle bar: 96 inches per rack
bottom bar: 148 inches per rack The fabric quality pull was 17 inches per rack. The total inches for an 84 inch panel by bar were as follows:

top bar: 2,280 ends
middle bar: 480 ends
bottom bar: 3,360 ends

The electrical charge dissipation characteristic of a fabric constructed in accordance with the present invention were tested and are set forth in Example 2.

EXAMPLE 2

A sample of antistatic fabric fabricated in accordance with the Example 1 was tested for effective surface resistivity and charge to decay time in accordance with the methods recommended in NFPA 99. The tests were conducted at a temperature of 70° F. and a relative humidity of 50%. The fabric measured approximately $6\times10^5$ ohms/cm. in the machine direction and $2\times10^6$ ohms/cm. in the crossmachine direction. Decay times in both directions were much less than 0.01 seconds. The material, therefore, easily met the resistance and decay specifications of NFPA 99.

It should be understood that this invention is not limited to the illustrations described and shown herein, which are deemed to be merely illustrative of the best modes of carrying out the invention. The invention also encompasses all such modifications which are within the scope of the following claims.

What is claimed is:

1. A knitted fabric having improved electrical charge dissipation properties comprised of a knit structure of non-conductive fiber stitches forming courses and wales and electrically conductive fibers fed up selected wales that traverse the fabric along the courses making electrical contact with the conductive fibers in other wales to form a matrix that dissipates electrical charge in substantially any direction.

2. The knitted fabric of claim 1 wherein the conductive fibers are chosen from the group consisting of carbon suffused nylon; filamentary polymer substrates having finely divided, electrically-conductive particles embossed on the fiber surface; and graphite fibers.

3. The knitted fabric of claim 1 wherein the conductive fibers consist of two or more conductive yarns plied together.

4. The knitted fabric of claim 1 wherein the conductive fibers consist of a conductive yarn plied together with a nonconductive yarn.

5. The knitted fabric of claim 1 wherein the conductive fiber is stitched so that the matrix contacts both the technical face and technical back of the fabric.

6. A knitted fabric having improved electrical charge dissipation properties and a modified Queens Cord construction fabricated by threading full the bottom bar of an 84 inch Mayer model KC3, 3 bar, 20 gauge warp knit tricot knitting machine with 150 denier textured polyester stitched 4-5, 1-0, the middle bar of the machine being threaded 6 ends out and one end in with 70 denier textured polyester plied with 2 ends per thread of conductive nylon and stitched in the following sequence:

1-0, 1-0, 0-1-1-0, 0-1, 1-0, 0-1, 1-0, 7-8, 7-8, 8-7, 7-8, 8-7, 7-8, 8-7, 7-8, and with an intermediate let off set up for the middle bar on a ratio of 1.21 and with a chain sequence of:

0-0-0, 6(4-4-4), 0-0-0, 0-0-0, 6(4-4-4) 0-0-0, and with a top bar threaded 6 ends in and one end out with 150 denier textured polyester stitched 1-0, 0-1.

7. A method of manufacturing a knitted fabric having improved electrical charge dissipation properties and a modified Queen's Cord construction comprising:

(a) threading full the bottom bar of an 84 inch Mayer model KC3, 3 bar, 20 gauge warp knit tricot knitting machine with 150 denier textured polyester stitched 4-5, 1-0;

(b) threading the middle bar of the machine 6 ends out and one end in with 70 denier textured polyester plied with 2 ends per thread of conductive nylon and stitched in the following sequence;

1-0, 1-0, 0-1, 1-0, 0-1, 1-0, 0-1, 1-0, 7-8, 7-8, 8-7, 7-8, 8-7, 7-8, 8-7, 7-8, (c) setting up an intermediate let off for the middle bar of the machine in a ratio of 1.21 with a chain sequence of:

0-0-0, 6(4-4-4), 0-0-0, 0-0-0, 6(4-4-4), 0-0-0, (d) threading the top bar of the machine 6 ends in and 1 end out with 150 denier textured polyester stitched 1-0, 0-1.

* * * * *